US005224529A

United States Patent [19]

Kenny

[11] Patent Number: 5,224,529

[45] Date of Patent: Jul. 6, 1993

[54] LATHE TOOL AND TOOLREST

[76] Inventor: Joseph A. Kenny, 4 St. Cynocs Terrace, Ferbane, Co. Offaly, Ireland

[21] Appl. No.: 788,940

[22] Filed: Nov. 7, 1991

[30] Foreign Application Priority Data

Nov. 8, 1990 [IE] Ireland ..... 4020/90

[51] Int. Cl.[5] ..... B27C 7/06

[52] U.S. Cl. ..... 142/42; 142/1; 142/49; 142/56; 144/365

[58] Field of Search ..... 82/158, 1.11, 12; 142/1, 42, 49, 55, 56; 144/33, 365

[56] References Cited

U.S. PATENT DOCUMENTS

| | | | |
|---|---|---|---|
| 259,196 | 6/1882 | Neff | 142/42 |
| 341,182 | 5/1886 | Stoner | 144/33 |
| 846,270 | 3/1907 | Watt | 144/33 X |
| 2,870,836 | 1/1959 | Rosato et al. . | |
| 2,914,098 | 11/1959 | McLennan, Sr. . | |
| 3,298,405 | 1/1967 | Loof | 144/33 X |
| 3,645,309 | 2/1972 | Canfield . | |
| 3,973,607 | 8/1976 | Jonsson . | |
| 4,063,577 | 12/1977 | Tennant . | |
| 4,082,126 | 4/1978 | Bebout . | |
| 4,924,924 | 5/1990 | Stewart | 142/49 |

FOREIGN PATENT DOCUMENTS

| | | |
|---|---|---|
| 0211997 | 3/1987 | European Pat. Off. . |
| 2107216 | 5/1972 | France . |
| 2462231 | 2/1981 | France . |
| WO90/05048 | 5/1990 | Int'l Pat. Institute . |

OTHER PUBLICATIONS

Lindquist, Mark, *Sculpting Wood: Contemporary Tools & Techniques* (Worcester, Mass.: Davis Publications, 1986), pp. 238–239.

"The Granville Mill", *Fine Woodworking*, Jan./Feb. 1990, by R. Ewald, pp. 53–55.

*Primary Examiner*—Steven C. Bishop

*Attorney, Agent, or Firm*—Young & Thompson

[57] ABSTRACT

A lathe tool and toolrest assembly is disclosed in which a cutting blade is attached across one end of a blade mounting shaft, which shaft may be rotated and/or slid lengthways with respect to the sleeve portion of a toolrest comprising a T-bar. A handle is attached to the other end of the blade mounting shaft for manipulating the tool. The tool may be used to remove a cylindrical core from a workpiece mounted on the lathe, or successively smaller cores so as to produce a set of nesting bowls. A set of blade attachments is also provided to hollow out a cylindrical core through a narrow opening in a workpiece. A frusto-conical core may be removed from a workpiece in conjunction with a double T-bar toolrest which serves as a universal joint when manipulating the tool.

9 Claims, 7 Drawing Sheets

LATHE TOOL AND TOOLREST

TECHNICAL FIELD

This invention relates to a tool and toolrest for use on wood turning lathes, in particular for turning bowls and the like.

BACKGROUND ART

At present, bowls and dishes are produced by gouging or carving out woodchips or shavings from a wooden blank or billet. Typically, the wooden blank is cylindrical in shape and a chisel-like tool is used to gouge out the core of the blank thereby producing a bowl-like object.

The toolrest on most lathes comprises an upstanding bar which is adjustable in position relative to the workpiece on which the tool may be freely supported, or steadied, by the turner, or which may provide for limited restraint such as one or more grooves to locate the tool, or a sleeve in which to slide the tool towards or away from the workpiece.

However, a number of disadvantages are associated with the existing methods of removing cores from wood blanks. In particular, in the chiselling method the wooden core is removed from a blank using a chiselling action. This is both time consuming, difficult and very wasteful as the core removed is in the form of shavings which cannot be used for further wood turning processes.

In another method the core is removed in the form of a cone. However, this is a difficult operation. As the core is removed the cutting tool becomes obscured from view with the danger of kickback if the tool jams. The cone removed is also wasteful of wood as the wood blank remaining on the lathe contains a conical interior which must then be turned or tooled to provide a cylindrical or rounded interior. The wood removed in this process is also in the form of shavings and so is also wasteful.

Although the cone removed from the blank may then be reused it is necessary to remove the sharp point from the cone so that the cone may be remounted on a lathe and a second wood turning operation performed on it. A sufficiently thick base must be left on the blank to avoid damage when the cone is knocked out, which may be undesirable, requiring further turning and waste to form a thinner base.

In addition, when the cone is being removed from the blank it is usually necessary to drive a wedge in between the gap between the cone and the walls of the blank and this frequently results in splitting of the wood and the bowl formed is therefore useless.

A further disadvantage associated with removing a core in the form of a cone from a wood blank is that the core must be relatively large if another bowl is to be formed from the core. Clearly, where the original blank is relatively small the possible uses of the core which is removed from the blank are limited.

Accordingly, a need exists for a wood turning device which reduces wood wastage, and is safe and easy to use. As the necessity for conservation of exotic and/or hardwoods increases, there is a greater incentive to minimise waste.

DISCLOSURE OF THE INVENTION

Wastage is substantially reduced by removing a cylindrical rather than a conical core from the blank using a tool in accordance with the invention in conjunction with a sleeve-type toolrest. Furthermore, removal of a cylindrical core allows a thinner base to be left on the blank remaining on the lathe, and a cylindrical core is easily used as a smaller blank to turn a further bowl, for example. A set of nesting bowls may even be produced from a single blank, i.e. by removing successively smaller cylindrical cores.

The present invention also provides tools for removing a frusto-conical core in one piece, without the necessity of "knocking out" the core. Hitherto, this has not been possible. A novel toolrest providing unlimited restraint on the tool allows the tool to be safely set at virtually any angle to the workpiece.

In another aspect, the invention provides novel tools for hollowing out a blank through a narrow opening leaving a cylindrical hollow inside the blank.

According to the invention there is provided a tool for use on a lathe comprising cutting means and a mounting member therefor, wherein the cutting means is secured across one end of the mounting member, and a toolrest adapted for slidable reception of the mounting member, such that upon lateral displacement of the cutting means in a plane transverse to the turning axis of the lathe when the tool is inserted in a previously formed aperture or annular groove in a workpiece mounted on the lathe, a cylindrical core or a frusto-conical core may be removed from the workpiece.

Preferably the toolrest comprises a stem adapted to be fixed to the lathe, and a sleeve portion transverse to the stem, such that the mounting member comprises a shaft slidable and rotatable with respect to the sleeve portion.

The mounting member preferably includes a handle engagable therewith at or near one end thereof. The handle is suitably a crank handle. The cutting means is preferably detachable from the mounting member. Most preferably, the cutting means is engagable in a groove formed on an end face of the mounting member. Alternatively, the cutting means is engagable with a flat surface provided on one side of the mounting member.

Alternatively the toolrest comprises means providing for a universal joint connection disposed between the toolrest stem and the mounting member. Preferably, said universal joint means comprises a second toolrest also comprising a stem portion and a sleeve portion transverse thereto, wherein the stem portion of the second toolrest is slidable and rotatable with respect to the sleeve portion of a first toolrest, and wherein the mounting member is slidable and rotatable with respect to the sleeve portion of the second toolrest.

DETAILED DESCRIPTION

Figure 1:
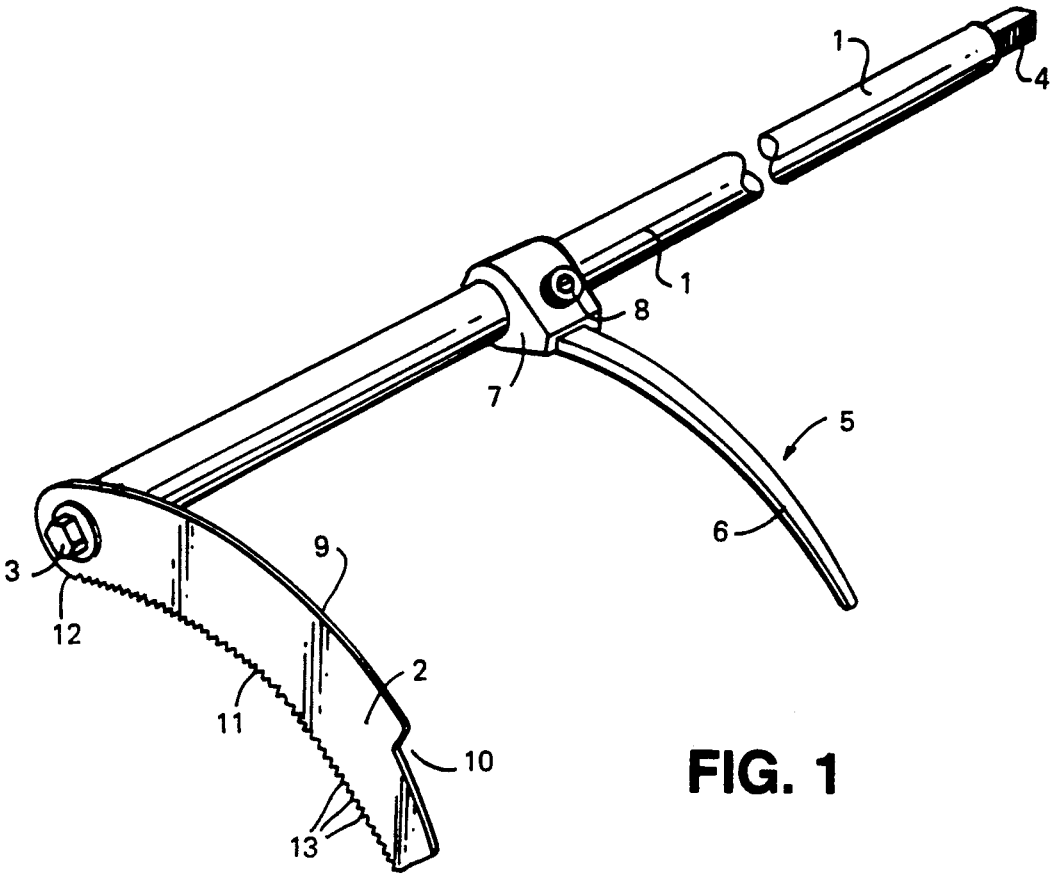
FIG. 1 is a perspective view of the tool blade.

As shown in FIG. 1, the tool comprises a shaft 1 having a blade 2 fixed at one end. The blade 2 is attached to the shaft 1 by means of a screw 3 or may be brazed onto the shaft. The screw 3 is inserted in the shaft 1 through a hole (not shown) on the blade 2. Alternatively, the shaft 1 and the blade 2 may be connected by means of a spigot and socket joint, so that the blade is easily removable from the shaft.

The shaft 1 is fitted with a mounting key 4 at its other end. The mounting key 4 is suitable for insertion in a complementary hole on a handle (not shown). Alternatively, the shaft 1 and the handle may be connected by means of a spigot and socket type joint.

The shaft 1 is further provided with an indicator 5 intermediate the blade 2 and the mounting key 4. The indicator 5 comprises an arcuate finger 6 which is attached to the shaft 1 via a mounting collar 7 through which the shaft 1 passes. The mounting collar 7 is slidable along the length of the shaft 1 and may be tightened and loosened by means of a set screw 8. The arcuate finger 6 is similar in length and shape to the blade 2.

In a further embodiment of the invention, the finger comprises a rod member slidably extendable from the mounting collar 7 so that the length of the finger may be adjusted to correspond with the length of any size blade which may be used and fixed with respect to the collar by means of a set screw. Accordingly, such an indicator is used to indicate the position of any blade size during the cutting process.

The blade 2 comprises a smooth outer edge 9 having a notch 10 at the end remote from the screw 3, and defines a cutting edge 11 at its inner edge 12 comprising substantially regular saw teeth 13 suitable for cutting through wood.

The notch 10 facilitates use of the blade 2 with relatively small pieces of cylindrical wood having a high degree of curvature (this will be more fully explained having regard to FIGS. 4 to 7).

Figure 2:
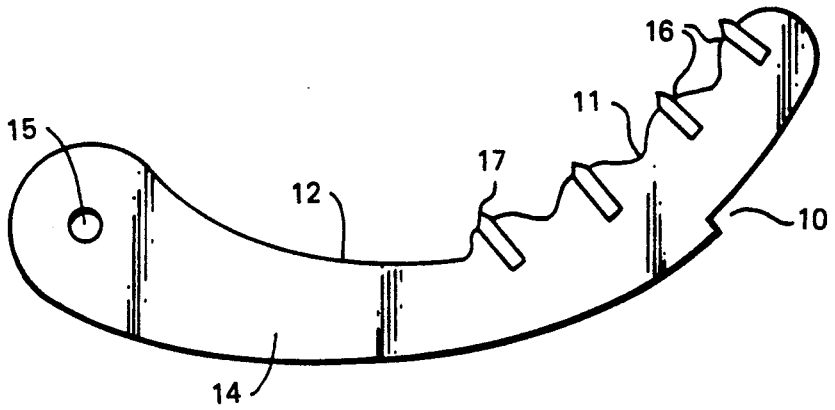
FIG. 2 is a plan view of an alternative tool blade for heavy duty use.

FIG. 2 shows an alternative blade 14 suitable for use with the tool. The alternative blade 14 is similar in shape although slightly larger than the blade 2 and is provided with a hole 15 through which a screw may be inserted to attach the blade 14 to a shaft. The blade 14 is also provided with a notch 10 at its outer end and with a cutting edge 11 on its inner edge 12. The cutting edge 11 does not extend the full length of the blade 14 but extends approximately half-way along the length of the inner edge 12. The cutting edge 11 comprises teeth 16 from which tungsten carbide tips 17 project. The tips 17 reinforce the teeth 16 and make the blade 14 suitable for heavy duty use with extremely tough woods. It will be appreciated however that many other blade profiles may be provided for particular uses, which need not be described in detail.

Figure 3:
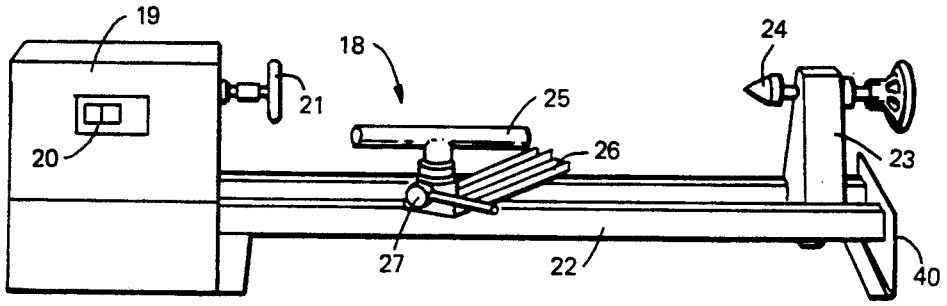
FIG. 3 is a side view of a spindle lathe suitable for use with the tool.

FIG. 3 shows a standard spindle lathe 18 suitable for use with the tool of the invention. The lathe 18 comprises a drive centre 19 fitted with an on/off switch 20. A headstock 21, on which a wood blank may be mounted, projects from the drive centre 19. The headstock 21 is rotatable and the speed of rotation is controlled by the drive centre 19. Bed-rails 22 on which a tailstock mounting 23 is mounted also extend from the drive centre 19 and terminate at a back plate 40. A tailstock 24 projects from the tailstock mounting 23 and is used to support a wood blank mounted on the headstock 21. The tailstock 24 is moved into position against a wood blank mounted on the headstock 21 by sliding the tailstock mounting 23 along the bed-rails 22. However, the tool is also suitable for use on a standard outboard lathe.

A toolrest 25 comprising a hollow T-bar through which the shaft 1 may be inserted, is mounted intermediate the headstock 21 and the tailstock 24 on the bed-rails 22 by means of a holder 26 which may be loosened and tightened by a locknut 27. The toolrest 25 is also provided with a second toolrest lock nut 32 on the underside of the bed rail 22. (See FIG. 4). The toolrest locknut 32 provides additional support for the toolrest 25.

Figure 4:
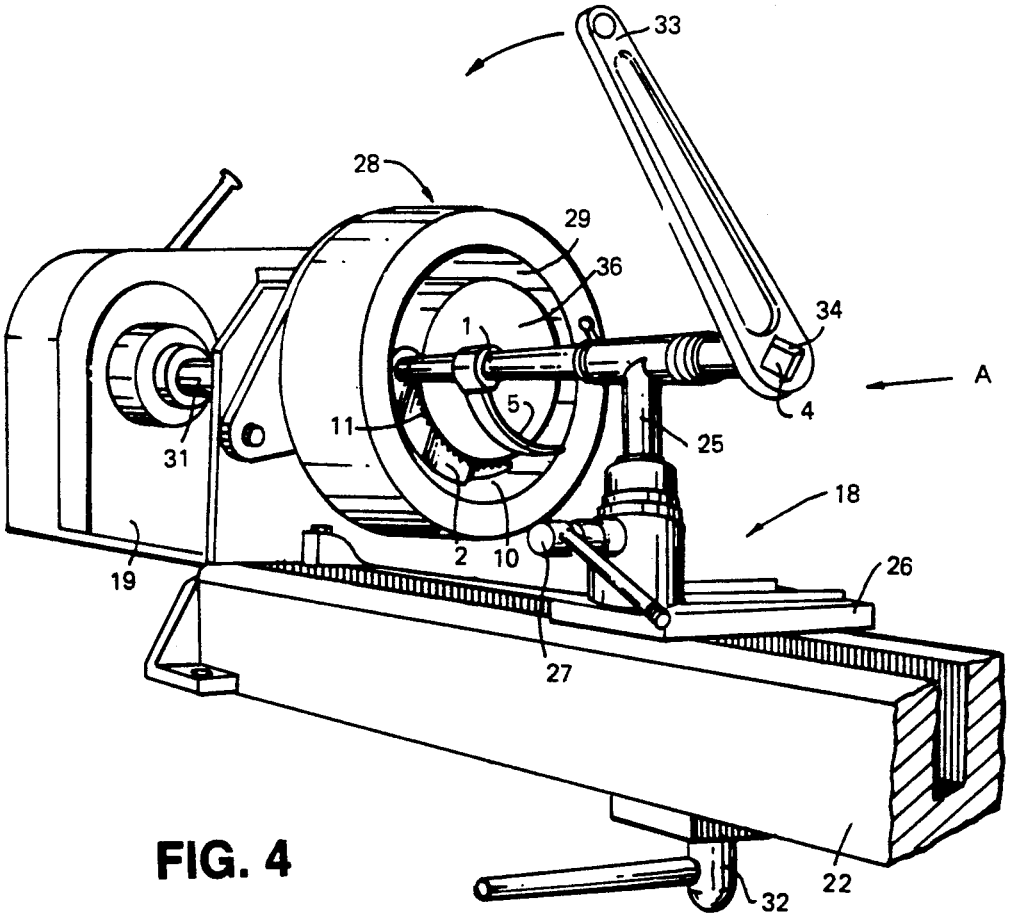
FIG. 4 is a perspective view of the end of the lathe of FIG. 3 showing the tool and a wooden blank mounted thereon.

The operation and use of the tool for turning a set of nesting bowls may be more fully understood having regard to FIG. 4.

A wood blank 28 is first mounted on the headstock 21 of the lathe 18 in the conventional manner, and a groove 29 is then chiselled into the blank 28. The groove 29 is sufficiently wide to accommodate the blade 2. The shaft 1 is then inserted through a sleeve in the toolrest 25, and the handle 33 is attached to the mounting key 4 as shown in FIG. 4. The shaft 1 is then slid along through the sleeve so that the blade 2 enters the groove 29. Alternatively, the toolrest 25 may be loosened and slid along the bed rail 22 into position.

Before inserting the blade 2 into the groove 29 it is ensured that the indicator 5 is parallel with and oriented in the same direction as the blade 2. This is to ensure that when the blade 2 is cutting beneath the core 36 to remove the core 36, the location of the blade 2 is indicated by the indicator 5 which remains on the outside of the wood blank 28. The user of the tool is therefore aware at all times of the location of the blade 2 within the wood blank 28 so that it is obvious when all cutting has been completed.

Once the wood blank 28 and the tool have been mounted on the lathe 18 and the blade 2 inserted in the groove 29, the handle 33 is gripped by the operator and the wood blank 28 rotated by activating the on/off switch 20 on the drive centre 19. The wood blank then rotates in an anti-clockwise manner which is towards the operator or user.

In order to effect a slicing or cutting action across the base of the core 36 in the blank 28 the operator pulls the handle 33 towards himself thereby effecting movement of the blade 2 in an anti-clockwise direction. Therefore the cutting edge 11 of the blade 2 engages the wood of the core 36 and cutting of the wood is effected.

As the wood blank 28 is moving in an anti-clockwise direction and the blade 2 is moving in an anti-clockwise direction cutting is effected "on the drag" i.e. the blade 2 cuts against the wood so that the operator can more easily control the cutting action thereby increasing the safety of the tool. The operator continues to pull the handle 33 towards himself thereby effecting anti-clockwise movement of the blade 2 so that the blade 2 progresses through the wood of the core 36. Movement of the obscured blade 2 through the wood may be monitored by means of the indicator 5 which indicates the exact location of the blade 2 in the wood of the core 36.

Figure 5:
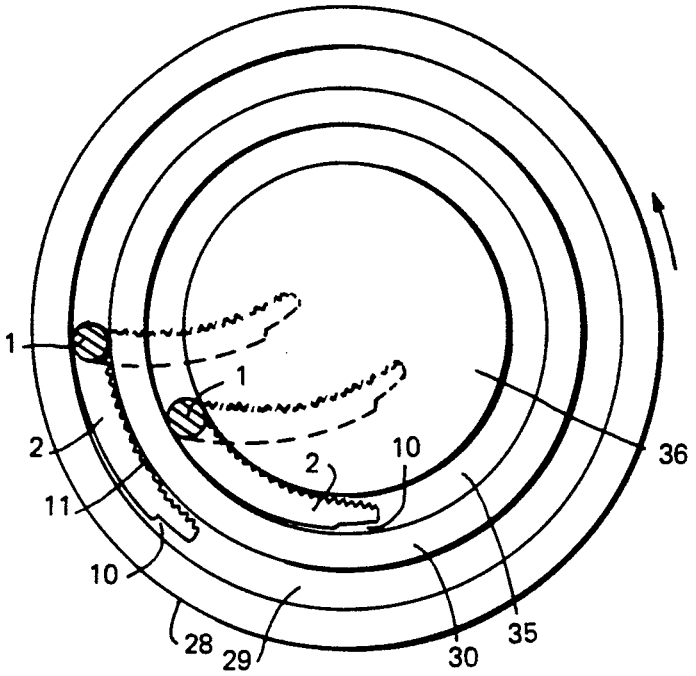
FIG. 5 is an elevation viewed in the direction of arrow A of the blade inserted in different grooves in a wooden blank, with the shaft omitted for clarity, illustrating the method by which a nest of bowls may be turned from a single wooden blank.
Figure 7:
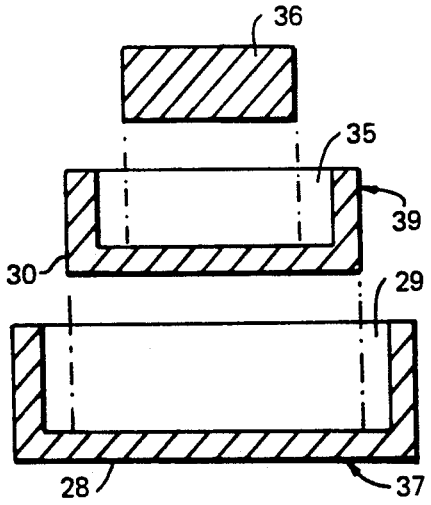
FIG. 7 is a longitudinal cross section through the blank and blocks shown in FIG. 6.
Figure 6:
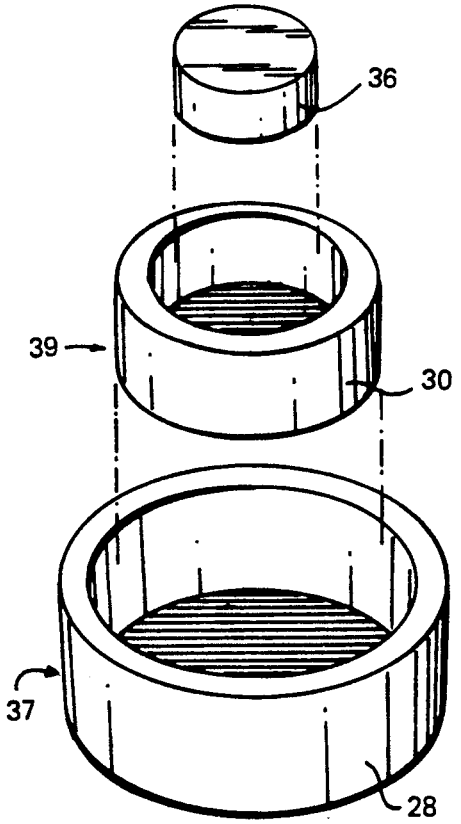
FIG. 6 is a perspective view of a blank showing the blocks that may be removed by the tool, in turning a nest of bowls.
Figure 8:
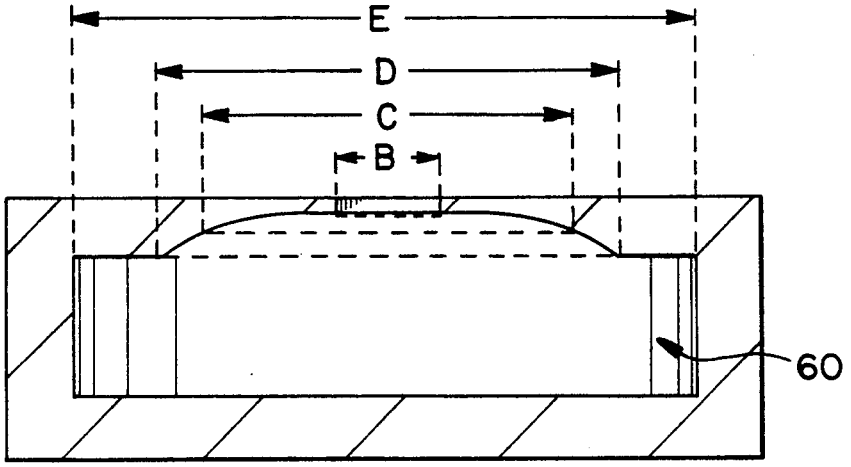
FIG. 8 is a cross-section of a cylindrical wooden blank, when hollowed out through a narrow opening, using a set of blades shown in FIGS. 9 to 13, FIGS. 9 and 9A are respectively side and front elevations of a blade for cutting the narrow opening of diameter B.

As shown in FIG. 5 a second shallower groove 35 may be chiselled out allowing core 36 to be removed. The blade 2 is moved through the wood towards the core until the tip of the blade 2 is fully displaced i.e. the blade 2 projects to the maximum extent into the wood of the core 36. The blade 2 therefore cuts through the wood of the core 36 in a circular manner so that when extended to its full extent the core 36 is detached from the main blank 28.

If the blade 2 does not cut completely through the wood to release a core, it is a relatively simple operation to "knock-out" the core from a blank, or replace the blade with a longer blade to release the core.

The blade 2 is easily accommodated by the groove 29 as the degree of curvature of the groove 29 is not excessive. However, the groove 35 has a relatively high degree of curvature due to the smaller diameter involved. The groove 35 may still accommodate the blade 2 due to the presence of the notch 10 on the edge 9 of the blade 2. The notch 10 decreases the width of the blade 2 at the outer end to produce an artificial increase in the degree of curvature of the blade 2 without reducing the overall length. Therefore, the blade 2 can be used with a wide range of blanks due to the presence of the notch 10. Accordingly. frequent changes of blades are not required.

It should be noted that cores or bowls 28, 30 and 36 can if desired be turned in order of increasing diameter i.e. bowls may be turned from the inside outwards. Accordingly, it is not necessary to remount each core 30,36 removed from the blank 28 for each turning operation. Each bowl is partly turned i.e. more or less cut completely from the blank 28 without requiring remounting between each turning operation. Usually, each bowl remains attached to the blank 28 by means of a small uncut piece of wood on its base. However, the woodturner may find it more preferable to remove and then replace the cores to turn a set of bowls in order of decreasing diameter.

It will be appreciated that the number of bowls which may be removed form a single blank of wood is increased from one to two or possibly three or more bowls, resulting in a set of nesting bowls. The number of bowls which can be removed from a single blank depends upon the diameter and depth of each blank. The smaller bowls may only require re-mounting on the lathe for finishing, whilst the largest bowl may be entirely turned and finished, e.g. sanded and polished, without removal from the original mounting.

In an alternative embodiment of the invention the size of the blades may be varied in order to turn a range of blank sizes. The shaft may also be varied in order to strengthen the shaft to allow for the cutting of tougher woods or larger blanks, for example four shafts of diameter 20 mm, 12 mm, 10 mm and 8 mm may be provided. However, the toolrest 25 will only grip a shaft generally with the largest outside diameter. Accordingly, in an alternative embodiment of the invention sleeves are provided for each of the other shafts so that one toolrest 25 will accommodate all of the other shafts. The sleeves slide over the shaft to increase its diameter so that the shaft can be securely gripped by the toolrest 25.

A series of blades of different sizes may be provided which would fit each one of the shafts thus allowing one kit to be used for a range of blank sizes.

Figure 15:
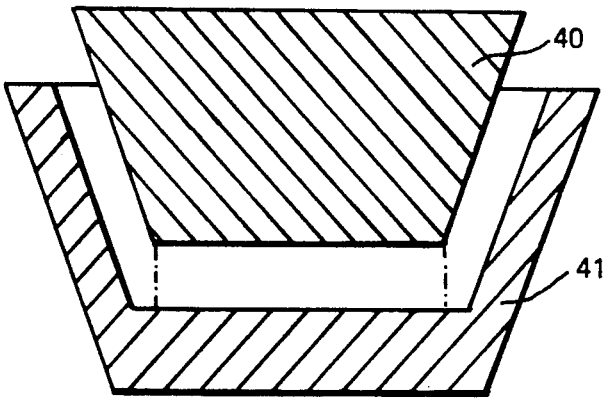
FIG. 15 is a cross-section of a bowl with tapered sides, in which a core is removed with the tool and toolrest arrangement shown in FIG. 14.
Figure 16:
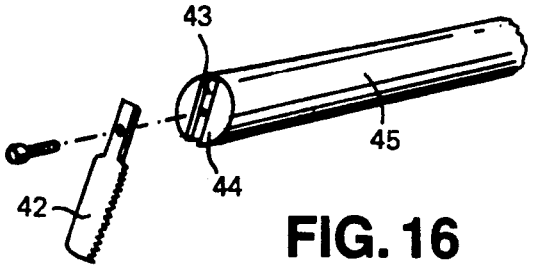
FIG. 16 is a detail perspective view of the angled setting of the cutting blade with respect to the mounting member, as shown in the arrangement in FIG. 14.

A further embodiment of the invention will be described with reference to FIGS. 14 to 16. Hitherto, in order to turn a bowl with tapered sides, it has been necessary to remove the central core in the form of a cone. However, the present invention provides a tool for removing a frusto-conical core 40 as shown in FIG. 15. Firstly, the groove is chased out of the blank mounted on the lathe, at an angle to the face of the blank 41. A cutting blade 42 is mounted at an angle in a locating groove 43 to extend across the end surface 44 of the mounting shaft 45, as shown in FIG. 16. The tool is then inserted into the angular groove in the blank to remove the frusto-conical core 40. It will be appreciated that rotation of the shaft 45 causes the blade 42 to move through an arc, as opposed to a plane. This may be compensated by a novel universal joint toolrest arrangement which is illustrated in FIG. 14, and which allows an unrestricted restraint to be applied to the tool.

Figure 14:
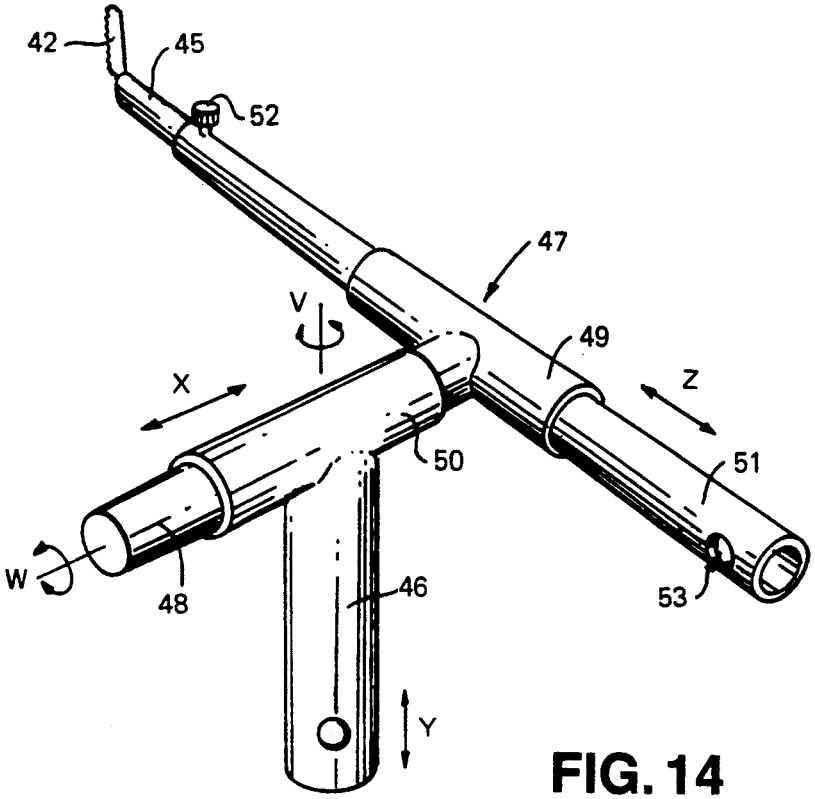
FIG. 14 is a perspective view of a universal joint type toolrest in accordance with another embodiment of the invention, showing a mounting shaft and blade assembled therewith.

The toolrest shown in FIG. 14 comprises a hollow T-bar 46, which is fixed to the lathe, but which may be adjusted up or down in the direction of arrow Y. A second T-bar 47 comprising a solid stem 48 and a hollow sleeve portion 49 is inserted into the sleeve portion 50 of the first T-bar 46. Thus, the T-bar 47 is capable of freely sliding in and out in the direction of arrow X within sleeve 50. Finally, a hollow mounting shaft 51 is slidable in the direction of arrow Z within the sleeve 49 of the second T-bar 47. The blade mounting shaft 45 is held in place by a set screw 52 to complete the assembly. Thus, the T-bars 46. 47 are adapted for rotation about respective axes V, W. and relative movement in the direction X, Y, Z is possible, making a universal joint type arrangement. A handle (not shown) is mounted at the other end of the shaft 51, for example by means of the hole 53. The operator thus has complete freedom of movement to manipulate the blade 42 to make the desired angled cut to separate the core 40 from the blank 41. This arrangement is considerably safer than prior art arrangements as the blade is at all times restrained by the tool rest.

Figure 21:
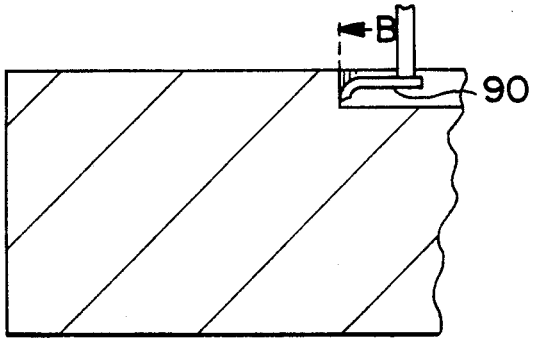
FIGS. 21 through 24 show successive stages in the production of the object shown in FIG. 8.
Figure 22:
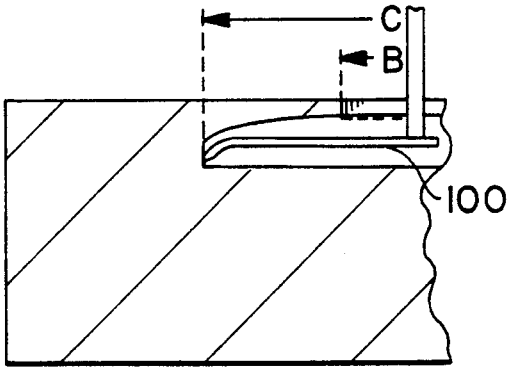
Figure 23:
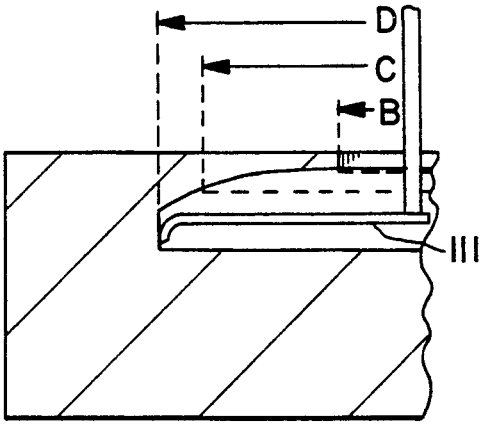
Figure 24:
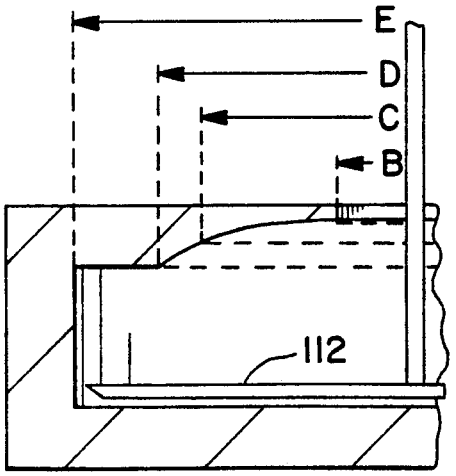
Figure 9:
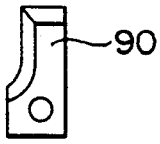
Figure 9A:
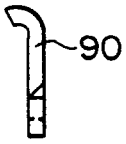
Figure 10:
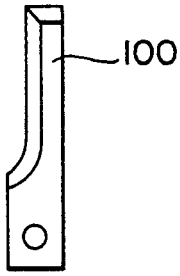
FIGS. 10 and 10A are respectively side and front elevations of a blade for hollowing diameter C.
Figure 10A:
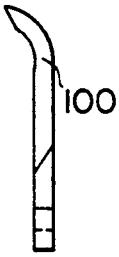
Figure 11:
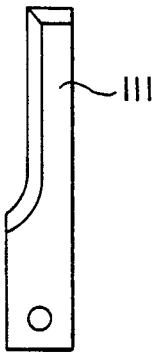
FIGS. 11 and 11A are respectively side and front elevations of a blade for hollowing diameter D.
Figure 11A:
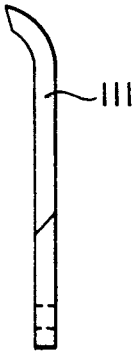
Figure 12:
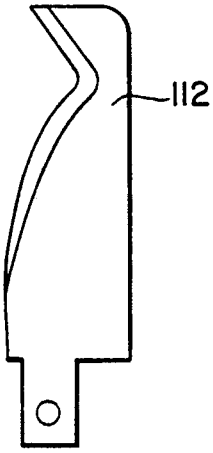
FIGS. 12 and 12A are respectively side and front elevations of a blade for hollowing diameter E.
Figure 12A:
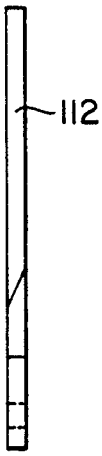
Figure 13:
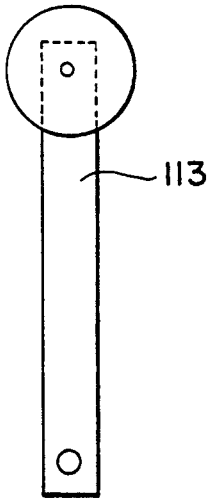
FIGS. 13 and 13A are respectively side and front elevations of an alternative blade for hollowing diameter E.
Figure 13A:
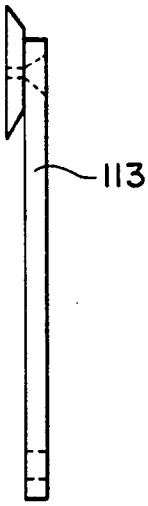

A novel method of hollowing out a cylindrical wooden blank through a narrow opening is also provided by the present invention, and will be described with reference to FIGS. 8 to 13. A set of blades as shown in FIGS. 9 to 12 is provided of increasing size. Firstly, the smallest blade 9 is attached to the tool, for example, in a groove defined across a flat end face of a blade mounting member, so as to project at right angles thereto. The smallest blade 9 is used to cut the opening of diameter B (FIG. 21). A larger blade as shown in FIG. 10 is then inserted into this opening to hollow out a diameter C (FIG. 22). A still larger blade as shown in FIG. 11 is used in a similar manner to hollow out diameter D (FIG. 23). It will be noted that the blades have a hooked profile which results in a domed opening being cut into the blank which makes it easier to insert subsequent blades. Once a large enough blade can be inserted, a cylindrical space 60 may be hollowed out using the blade as shown in FIG. 12 (FIG. 24), or the alternative blade as shown in FIG. 13. A blade mounting shaft and indicator finger similar to that shown in FIG. 1 may be used, and during turning, the shaft is moved with a handle as described above.

Figure 17:
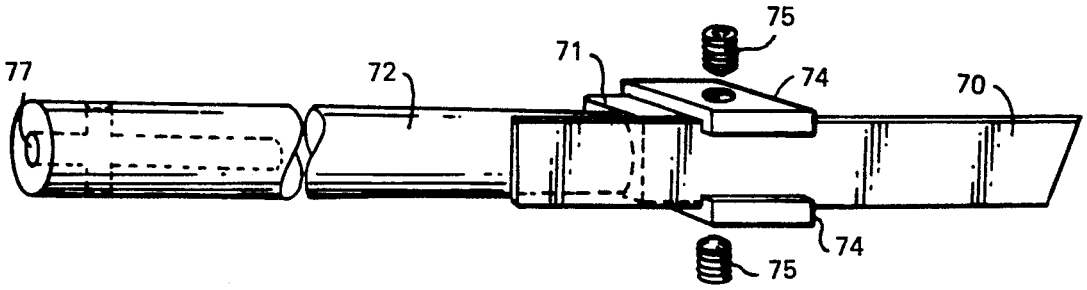
FIG. 17 is a side perspective view of a mounting member having a square end showing the mode of attachment of a parting blade.
Figure 18:
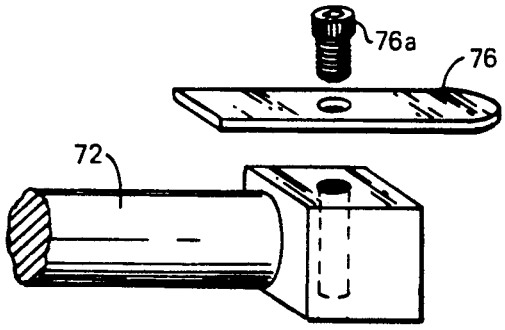
FIG. 18 is a side perspective view of a detail of the mounting member of FIG. 17 showing the mode of attachment of a moulding profile blade.

Many different types of blades may be fitted to the blade mounting shaft besides cutting blades mounted transverse to the end of the shaft. In one example, a parting blade 70, as shown in FIG. 17, is mounted against one side of a squared end section 71 of blade mounting shaft 72 by means of holding plates 73, 74 secured against opposite sides of the square 71 by means of grub screws 75. In another example, a moulding profile blade 76 may be attached to the blade mounting shaft 72 by means of a set screw 76. The tools illustrated in FIGS. 17 and 18 are generally used from one side on the outside of the workpiece. In another example, the blade mounting shaft may be adapted so as to receive the drive shaft of a drill, for example with aperture 77, whilst the other end of the mounting shaft may be adapted to receive the chuck of the drill, such that the workpiece may be drilled with the mounting shaft free to rotate in the sleeve portion of the T-bar toolrest.

In the method of turning a set of nesting bowls described above, a groove must first be chased out of the blank with a plunger or slicer chisel. Such a tool may be adapted to engage with the blade mounting shaft, for example in aperture 77, to project in line therefrom, and may be used in conjunction with the sleeve of the T-bar toolrest.

Figure 19:
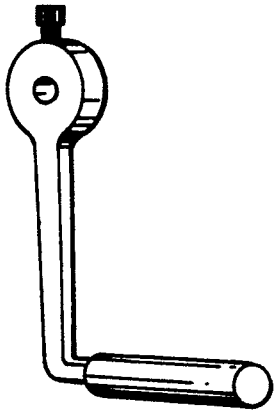
FIGS. 19 and 20 show perspective views of alternative handles for use with the tool.
Figure 20:
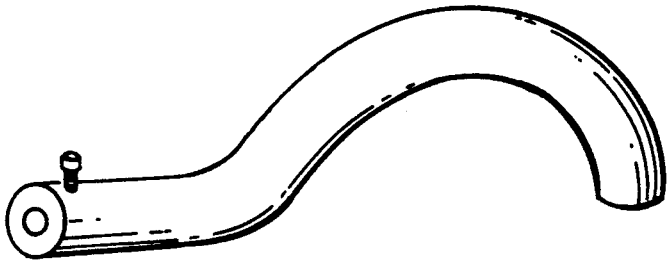

A crank handle is preferably fitted to one end of the blade mounting shaft, such as the crank handle shown in FIG. 19, or the swan-neck handle shown in FIG. 20. Both of these handles are easily removed, and may be used attached to any of the tools described above, for free hand work, if it is not desired to use the T-bar toolrest. It will therefore be appreciated that a very versatile kit of parts may be provided, with many elements being interchangeable.

Although the embodiments described relate solely to wood turning lathes, it will readily be appreciated by those skilled in the art that the invention may be applied to other types of lathe including metal working, and thus the foregoing description should not be construed as limiting the invention to lathes suitable for wood-turning only.

I claim:

1. A tool for use on a wood-turning lathe comprising cutting means and a mounting member therefor, slidable within a toolrest, wherein the cutting means is secured across one end of the mounted member, and adapted for lateral displacement in a plane transverse to the turning axis of the lathe when the tool is inserted in a previously formed aperture or annular groove in a workpiece mounted on and lathe, and means for securing a handle across the opposite end of the mounting member whereby a person using the tool can manually steady the tool within the troolrest, such that a cylindrical core may be removed from the workpiece.

2. A tool according to claim 1 wherein the toolrest comprises a stem adapted to be fixed to the lathe, and a sleeve portion transverse to the stem, such that the mounting member comprises a shaft slidable and rotatable with respect to the sleeve portion.

3. A tool according to claim 2 wherein the cutting means is detachable from the mounting member.

4. A tool according to claim 3 wherein the cutting means is engagable in a groove formed on an end face of the mounting member.

5. A tool according to claim 4 wherein the cutting means is engagable with a flat surface provided on one side of the mounting member.

6. A method of turning a set of nesting bowls from a single workpiece mounted on a conventional wood-turning spindle lathe comprising the steps of:

a) forming a first circular groove in the workpiece,
b) inserting an arcuate cutting blade in said groove, disposed transverse to the turning axis of the lathe,
c) rotating in a clockwise direction by applying a manual force to a handle fixed to the blade the arcuate blade so as to remove a cylindrical core,
d) forming a second circular groove in the remaining workpiece,
e) inserting a larger arcuate blade in said groove, disposed transverse to the turning axis of the lathe,
f) rotating in a clockwise direction by applying a manual force to a handle fixed to the blade the larger arcuate blade so as to remove a bowl from the workpiece having cylindrical side walls, and
g) removing the remaining workpiece in the form of a larger bowl having cylindrical side walls from the lathe.

7. A method of removing a cylindrical core from a workpiece mounted on a lathe, comprising the steps of a) cutting a narrow opening in the centre of the workpiece,
b) inserting a blade through said opening disposed transverse to the turning axis of the lathe and rotating said workpiece to widen the base of the opening,
c) replacing said blade in step b) with successively longer blades so as to deepen and widen the hollow cut by said blades through said narrow opening.

8. A tool for use on a wood-turning lathe comprising cutting means and a mounting member therefor slidable within a toolrest, wherein said toolrest comprises a steam adapted to be fixed to the lathe, and a sleeve portion transverse to the stem, means are provided for a universal joint connection disposed between the toolrest stem and the mounting member, the mounting member having secured across one end thereof cutting means, and across the opposite end a handle, whereby the cutting means is adapted for lateral displacement in a plane transverse to the turning axis of the lathe by means of manual manipulation to the tool by a user grasping the handle when the tool is inserted in a previously formed aperture or groove in a workpiece mounted on the lathe, such that a cylindrical or a frusto-conical core may be removed from the workpiece.

9. A tool in accordance with claim 8 wherein the universal joint connection comprises a first T-bar and a second T-bar, each comprising a stem portion and a sleeve portion transverse thereto, wherein the stem portion of the second T-bar is slidable and rotatable with respect to the sleeve portion of the first T-bar, and wherein the mounting member is slidable and rotatable with respect to the sleeve portion of the second T-bar.

* * * * *